US010648617B1

(12) United States Patent
Xu et al.

(10) Patent No.: US 10,648,617 B1
(45) Date of Patent: May 12, 2020

(54) AUTOMATIC GAS CYLINDER FILLING SYSTEM AND OPERATING INSTRUCTIONS

(71) Applicant: Jining Xieli Special Gas Co., ltd, Shandong (CN)

(72) Inventors: Yong Xu, Shandong (CN); Yan He, Shandong (CN)

(73) Assignee: Jining Xieli Special Gas Co., ltd, Shandong (CN)

( * ) Notice: Subject to any disclaimer, the term of this patent is extended or adjusted under 35 U.S.C. 154(b) by 0 days.

(21) Appl. No.: 16/167,479

(22) Filed: Oct. 22, 2018

(51) Int. Cl.
*F17C 5/00* (2006.01)

(52) U.S. Cl.
CPC ..... *F17C 5/005* (2013.01); *F17C 2201/0119* (2013.01); *F17C 2201/032* (2013.01); *F17C 2205/013* (2013.01); *F17C 2205/0326* (2013.01); *F17C 2227/042* (2013.01); *F17C 2227/045* (2013.01); *F17C 2250/03* (2013.01); *F17C 2250/0421* (2013.01); *F17C 2250/0478* (2013.01); *F17C 2250/0615* (2013.01); *F17C 2250/075* (2013.01); *F17C 2260/02* (2013.01); *F17C 2260/04* (2013.01); *F17C 2270/059* (2013.01)

(58) Field of Classification Search
CPC ..... F17C 5/005; F17C 2270/059; F17C 2250/0615; F17C 2227/04
See application file for complete search history.

(56) References Cited

U.S. PATENT DOCUMENTS 4,557,300 A * 12/1985 Jernberg ..... F17C 5/005 141/346
2013/0213521 A1* 8/2013 Isom ..... F17C 5/00 141/4

FOREIGN PATENT DOCUMENTS

CN 1110387 10/1995
EP 0660026 B1 * 8/1998 ..... F17C 5/005

* cited by examiner

*Primary Examiner* — Timothy P. Kelly
(74) *Attorney, Agent, or Firm* — JCIPRNET

(57) ABSTRACT

The disclosure discloses an automatic gas cylinder filling device and an operating method thereof, includes a stand, an electronic scale, a PLC control unit, and a vacuum pump installed on an inner bottom plate of the stand. One side of the stand is provided with an 8-bottle gas cylinder rotating and weighing mechanism, a gas cylinder fixing mechanism, a gas cylinder filling fixture, a lifting frame and a bottle valve hand wheel switch mechanism that are arranged in sequence from bottom to top. The electronic scale is located below the 8-bottle gas cylinder rotating and weighing mechanism. The disclosure is used for filling gas cylinders, wherein the weighing, the fixing of the bottle valve and the rotation of the hand wheel are all automatically controlled and operated by the PLC control unit, and there is no need for operator to stay with the facility. The operation can be completed through operating the PLC control unit in the operation room, thereby preventing the filling personnel from being exposed to danger and harmed during the gas filling process. Meanwhile, the gas filling efficiency is greatly improved, the accuracy of the weighing is also ensured, and the proportion of each gas is highly accurate.

15 Claims, 5 Drawing Sheets

AUTOMATIC GAS CYLINDER FILLING SYSTEM AND OPERATING INSTRUCTIONS

BACKGROUND OF THE DISCLOSURE

Technical Field

The invention relates to an automatic gas cylinder filling device and its operating instructions, and belongs to the technical field of method and device for liquefying, solidifying or compressing gas into a pressure vessel.

Technique Background

The current Gas mixing process includes the following steps:

1. Manually calculate the portion of each gas ingredient, and work out the adding sequence.
2. Place the clean gas cylinder on the precision balance, tare and tighten the clamp manually.
3. Open the valve on the pipeline, then open the vacuum pump and the vacuum valve in order to vacuum entire pipeline.
4. Open the raw material valve and fill the gas cylinder with calculated gas ingredient in order.

Since a gas cylinder often needs to be filled with a few kinds of gas, and the requirement for specific content of each gas is high, weighing is performed after filling of each kind of gas. Manual operation often causes more errors and single kind of gas may need to be filled for several times, which greatly affects the efficiency. In addition, gas mixing can be a dangerous process as the cylinder is a high-pressure vessel, and some of the gas is toxic and flammable.

SUMMARY OF THE DISCLOSURE

The present disclosure aims to solve the deficiencies in the related art. This device aims to increase the effeminacy, accuracy and safety of gas mixing process.

The disclosure is achieved by following technical solutions:

An automatic gas cylinder filling device includes a stand (2), an electronic scale (35), a PLC control unit, and a vacuum pump (1), which is installed on an inner bottom plate of the stand. One side of the stand (2) is provided with an 8-bottle gas cylinder rotating and weighing mechanism (33), a gas cylinder fixing mechanism, a gas cylinder filling fixture (14), a lifting frame (36) and a bottle valve hand wheel switch mechanism arranged in sequence from bottom to top. The electronic scale (35) is located below the 8-bottle gas cylinder rotating and weighing mechanism (33). The electronic scale (35), the gas cylinder filling fixture (14), the bottle valve hand wheel switch mechanism, and the lifting frame (36) are respectively connected to the PLC control unit.

The device is used for automatic proportioning of standard gases, wherein the weighing, the fixing of the bottle valve and the rotation of the hand wheel are all automatically controlled and operated by the PLC control unit. There is no need for operators to stay with the device. The operation can be completed through operating the PLC control unit in the operation room, thereby preventing the operator from being exposed to danger and harmed during the gas mixing process. Meanwhile, the gas mixing efficiency is greatly improved, the accuracy of the weighing is also ensured, and the proportion of each gas is highly accurate.

Furthermore, the 8-bottle gas cylinder rotating and weighing mechanism includes a bottle bracket (28), a rotary disc, and a lifting cylinder (32). The gas cylinder (19) sits in the bottle bracket. On a bottom plate of the bottle bracket, there are four positioning shafts (27) and four positioning sleeves (26), the rotary disc may be rotated and positioned in sequence. A piston rod of the lifting cylinder is provided with a rotating pallet (33). A rotating support (34) and a stepper motor (31) are secured below an axis of the rotating pallet (33). The stepper motor (31) is connected to the PLC control unit. The gas cylinder is movable in upper and lower directions and rotated along the bottle bracket (28), the lifting cylinder (32), and the rotary disc, thereby facilitating transportation and weighing of the gas cylinder.

Further, the gas cylinder fixing mechanism (see FIG. 3) is fixedly provided with four fixture fixing brackets (23) at upper end. In addition, the gas cylinder fixing mechanism further includes two gas cylinder fixing fixtures (24) and two bidirectional ball screws (25). Each of the bidirectional ball screws (25) passes through the two fixture fixing brackets (23) and the two gas cylinder fixing fixtures (24), and one end of each of the bidirectional ball screws (25) is connected with a synchronizing belt pulley (20). One of the synchronizing belt pulleys is provided with a manual crank (22), and the two synchronizing belt pulleys are wound with a clamping synchronizing belt (21).

Further, the gas cylinder filling fixture is disposed in the lifting frame (36). The bottle valve hand wheel switch mechanism (FIG. 5) is installed at an upper end of the lifting frame (36). The bottle valve hand wheel switch mechanism includes a switch bottle valve motor (8). A dynamic torque sensor (9) and a hand wheel clamping mechanism are mounted on the rotating shaft of the switch bottle valve motor (8).

Further, the gas cylinder filling fixture (see FIG. 4) includes two clamp bottle valve cylinders (13). The clamp bottle valve cylinders (13) are double piston rod cylinders, and the piston rod of the two clamp bottle valve cylinders (13) is connected to a set of gas filling hose fixture (39). The clamp bottle valve cylinder (13) is connected to the PLC control unit.

Further, a dynamic torque sensor (9) and a pneumatic rotary joint (10) are disposed on the rotating shaft of the switch bottle valve motor (8), and the hand wheel clamping mechanism is mounted on the pneumatic rotary joint (10).

Further, the hand wheel clamping mechanism (see FIG. 5) includes a slide cylinder (11), and both ends of a sliding table of the slide cylinder (11) are provided with claws (12). The claws (12) are arranged vertically corresponding to the sliding table, and the slide cylinder (11) is connected to the PLC control unit.

Further, the lateral surface of the stand (2) is further provided with a lifting mechanism, and the lifting mechanism includes a lifting stepper motor (18), a pair of ball screws (7) and a pair of synchronizing belt pulleys (6). An output shaft of the lifting stepper motor (18) is connected to one of the ball screws (7). Another end of the one of the ball screws is connected to a synchronizing belt pulley, and another one of the ball screws is connected to another one of the synchronizing belt pulleys. A synchronizing belt (5) is wound around the two synchronizing belt pulleys. The lifting stepper motor (18) simultaneously drives the two ball screws (7) to operate synchronously through a pair of synchronizing belt pulleys and a synchronizing belt wound thereon. Each of the ball screws is provided a nut (4), which is secured at an upper end of the lifting frame (36).

Further, the lifting frame (36) is further provided with a center detecting sensor (16) and a height detecting sensor (17) for detecting the falling position of the lifting frame.

A method for operating the automatic gas cylinder filling device of the present disclosure includes following steps:

Step 1: A plurality of gas cylinders (19) are loaded into a cylinder fixing mechanism in sequence, and the gas cylinders are fixed by using the cylinder fixing mechanism.

Step 2: The gas cylinders are lifted and rotated in a curved manner together with the rotary disc in the 8-bottle gas cylinder rotating and weighing mechanism. A bottle valve of each gas cylinder is pre-aligned so that a direction of a gas inlet of the bottle valve is identical. After rotating to reach a concentric position of the lifting frame (36), the direction of the gas inlet of the bottle valve and the gas cylinder filling fixture correspond to each other.

Step 3: The lifting stepper motor (18) drives the lifting frame (36) to descend. The center detecting sensor (16) detects an opposite signal, and a center of the gas cylinder filling fixture is stopped when being concentric with a center of the bottle valve. The PLC control unit controls the gas cylinder filling fixture to fix the gas cylinder valve (38).

Step 4: The lifting stepper motor (18) drives the lifting frame (36) to continue to descend. When the height detecting sensor (17) detects a highest position of the bottle valve (19), the claws of the hand wheel clamping mechanism can be accurately engaged with the hand wheel. The PLC control unit controls the slide cylinder (11) to drive the claws to clamp the hand wheel. At this time, the gas cylinder filling fixture is in a suspended state.

Step 5: The lifting cylinder (32) of the 8-bottle gas cylinder rotating and weighing mechanism is automatically descended by control of the PLC control unit. The gas cylinder fixing mechanism stably falls on the electronic scale (35), and the PLC control unit controls weighing and peeling of the gas cylinder.

Step 6: The PLC control unit controls the bottle valve hand wheel switch mechanism to rotate the hand wheel according to the opening direction of the bottle valve, that is, the bottle valve is opened, and the PLC control unit controls the vacuum pump (1) to start vacuuming the gas cylinder.

Step 7: When a vacuum degree reaches predetermined set value, the PLC control unit controls to turn off the vacuum pump (1). The PLC control unit sequentially controls each source cylinder to be filled into the gas cylinder according to a built-in calculation software in the gas filling system. Each filling needs to be weighed. After reaching a predetermined weight, the PLC control unit controls the valve on the gas pipeline to be closed. When each gas is filled into the gas cylinder with a pre-calculated amount, the PLC control unit controls the bottle valve hand wheel switch mechanism to rotate the hand wheel in a closing direction of the bottle valve, that is, the bottle valve (38) is closed.

Step 8: The lifting stepper motor (18) lifts the lifting frame (36) until the gas cylinder filling fixture contacts a bottom end of the lifting frame (36). The PLC control unit controls the gas cylinder filling fixture to loose. At this time, the gas cylinder filling fixture and the gas cylinder valve (38) are completely detached from each other.

Step 9: The lifting stepper motor (18) continues to lift the lifting frame (36) until the lifting frame is lifted to an initial position, thereby completing a gas cylinder filling process, and same process is repeated sequentially to complete the filling process of the 8-bottle gas cylinders.

The weighing in the step 5 and the step 7 includes following steps:

Step 1: The PLC control unit controls the lifting cylinder (32) to drive the gas cylinder fixing fixture (24) and the gas cylinder (19) to be completely lifted and separated from the electronic scale (35). Thereafter, the PLC control unit controls the electronic scale (35) to be zeroed.

Step 2: The PLC control unit controls the lifting cylinder (32) to drive the gas cylinder fixing fixture (24) to fall until the bottom plate of the gas cylinder fixing fixture (24) contacts the electronic scale (35) and the gas cylinder fixing fixture (24) is completely detached from the 8-bottle gas cylinder rotating and weighing mechanism. At this time, the gas cylinder (19) and the gas cylinder fixing fixture (24) are completely landed on the electronic scale (35), and the PLC control unit controls the electronic scale (35) to weigh the gas cylinder (19).

In the step 6 and the step 7, controlling the bottle valve hand wheel switch mechanism to rotate the hand wheel mechanism by the PLC control unit includes following steps:

Step 1: The PLC control unit controls the switch bottle valve motor (8) to rotate, and the switch bottle valve motor (8) drives the bottle valve hand wheel switch mechanism to rotate together with the hand wheel.

Step 2: During closing or opening of the bottle valve (38), the dynamic torque sensor (9) transmits a signal to the PLC control unit after sensing a preset torque value. Then, the PLC control unit controls the switch bottle valve motor (8) to stop rotating.

As compared with the related art, the present disclosure has the following advantageous effects.

The disclosure is used for filling a gas cylinder, wherein the weighing and fixing of the bottle valve and the rotation of hand wheel are all automatically operated by the PLC control unit. There is no need for operators to stay with the device. The operation can be completed through operating the PLC control unit in the operation room, thereby preventing the filling personnel from being exposed to danger and harmed during the gas filling process. Meanwhile, the gas filling efficiency is greatly improved, the accuracy of the weighing is also ensured, and the proportion of each gas is highly accurate.

DESCRIPTION OF EMBODIMENTS

Details of specific embodiments of the present disclosure are further described in detail below with reference to the accompanying drawings.

Figure 1:
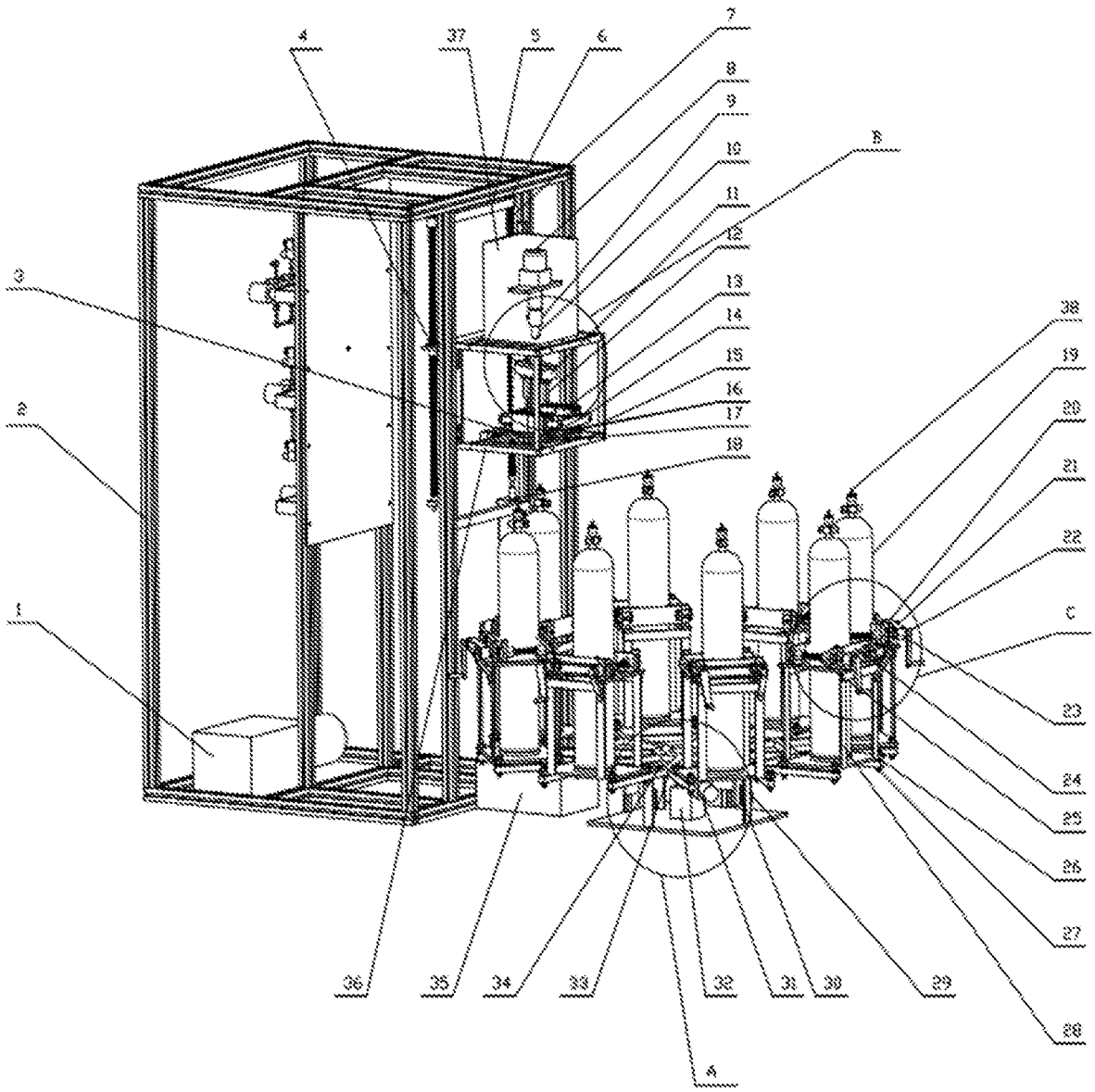
FIG. 1 is a schematic structural view of an automatic gas filling device.

An automatic gas cylinder filling device as shown in FIG. 1 includes a stand (2), a PLC control unit, an electronic scale (35), and a vacuum pump (1) mounted on an inner bottom plate of the stand (2). One side of the stand (2) is provided with an 8-bottle gas cylinder rotating and weighing mechanism, a gas cylinder fixing mechanism, a gas cylinder filling fixture, a lifting frame, and a bottle valve hand wheel switch mechanism arranged in sequence from bottom to top. The electronic scale (35) is located under the 8-bottle gas cylinder rotating and weighing mechanism. The gas cylinder filling fixture (14) is disposed within the lifting frame (36). The gas cylinder filling fixture (14) is connected to one main gas transmission hose. The main gas transmission hose communicates with a plurality of gas transmission hoses bus bars respectively, and each gas transmission hose is connected with one pneumatic value. Each gas transmission hose is provided with a gas source cylinder. The vacuum pump (1) also communicates with the main gas transmission hose through a gas transmission hose. The gas transmission hose is provided with a vacuum valve. The opening and closing of the pneumatic valve and the vacuum valve are controlled by the PLC control unit.

Further, the electronic scale (35), the gas cylinder filling fixture, the bottle valve hand wheel switch mechanism, and the lifting frame (36) are respectively connected to the PLC control unit.

Figure 4:
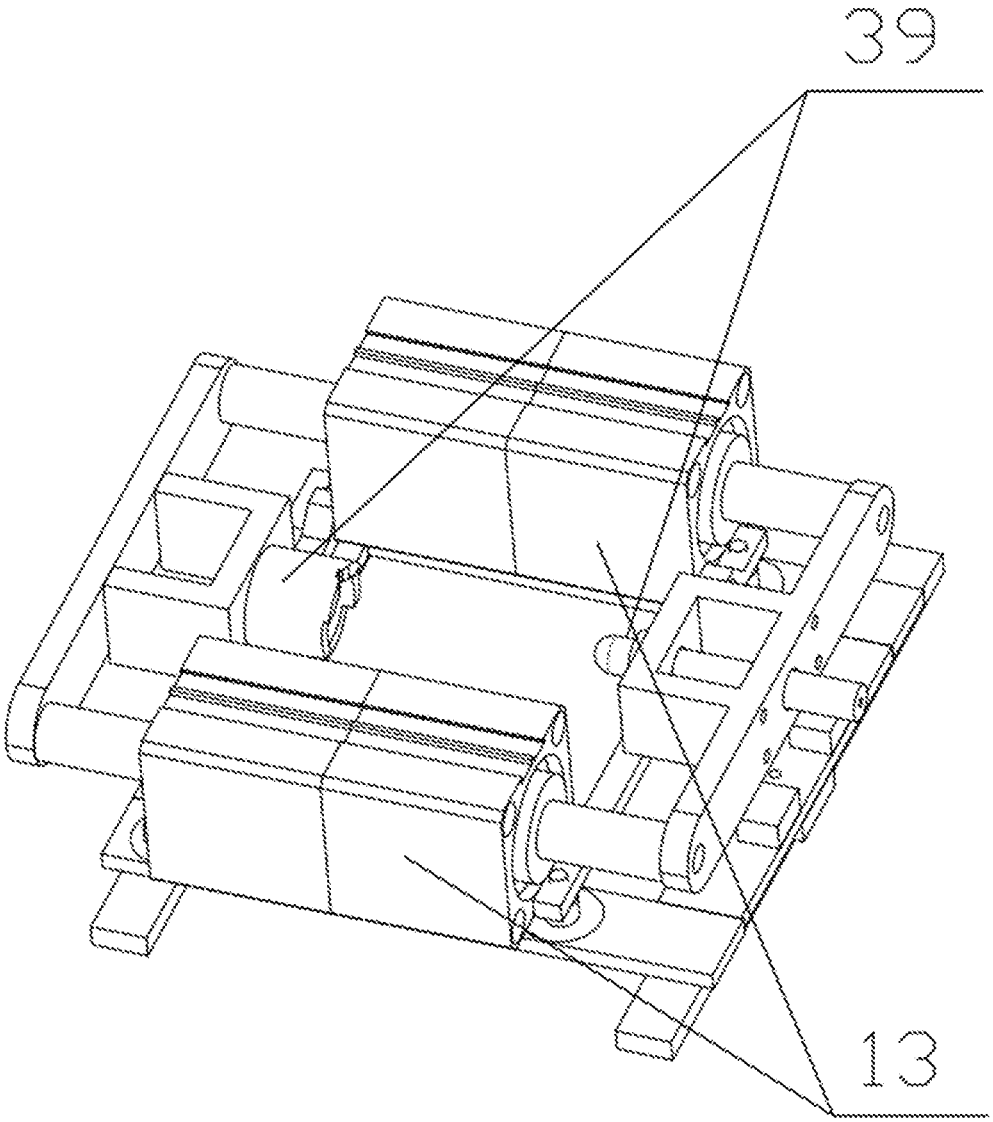
FIG. 4 is a schematic structural view of a gas cylinder filling fixture.

Further, a lateral surface of the stand (2) is further provided with a lifting mechanism. The lifting mechanism the gas cylinder filling fixture (FIG. 4). The lifting mechanism includes a lifting stepper motor (18), a pair of ball screws (7), and a pair of synchronizing belt pulleys (6). The output shaft of the lifting stepper motor (18) is connected to one of the ball screws (7), and another end of the ball screw (7) is connected to one of the synchronizing belt pulleys, and the other one of the ball screws is connected to another one of the synchronizing belt pulleys. The synchronizing belts (5) are wound on the two synchronizing belt pulleys. The lifting stepper motor (18) simultaneously drives the two ball screws (7) for synchronous operation through the pair of synchronizing belt pulleys and the synchronizing belt wound thereon through the synchronizing belt pulley (6) at the other end and the synchronizing belt (5) wound therewith. Each of the ball screws is provided with a nut (4), and the nut (4) is fixedly disposed on an upper end of the lifting frame (36) the gas cylinder fixture lifting mechanism. The top end of the lifting frame (36) is provided with an explosion-proof plate (37), and the lateral surface thereof is further provided with a center detecting sensor (16) and a height detecting sensor (17) for detecting a landing position of the lifting frame.

Figure 2:
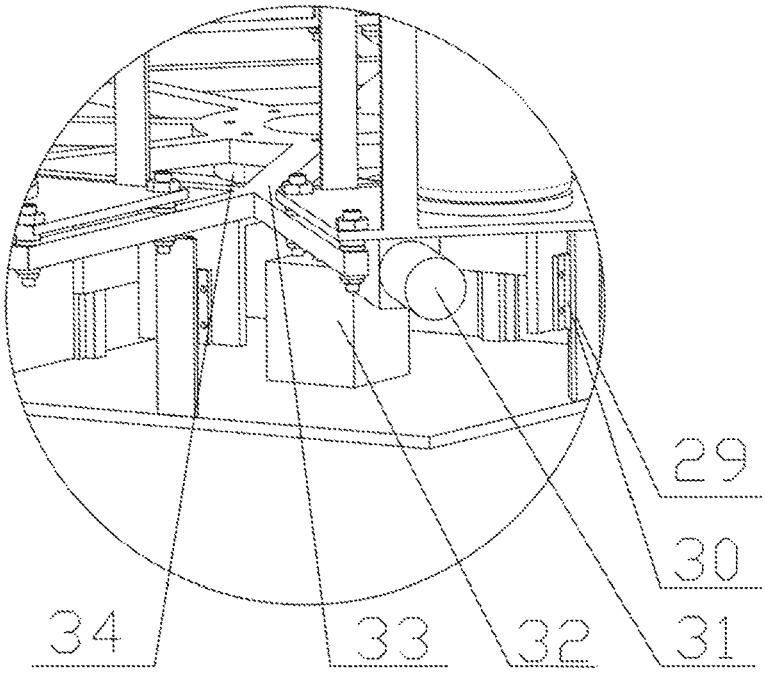
FIG. 2 is a schematic partial enlarged structural view of region A in FIG. 1.

Further, as shown in FIG. 1 and FIG. 2, the 8-bottle gas cylinder rotating and weighing mechanism includes a bottle bracket (28), a rotary disc and a lifting cylinder (32). The gas cylinder (19) is arranged in the bottle bracket. There are four positioning shafts (27) and four positioning sleeves (26) fixed on a bottom plate of the bottle bracket. The rotary disc is rotatable and may be rotated and positioned in sequence. The piston rod of the lifting cylinder is provided with a rotating pallet (33). A rotating support (34) and a stepper motor (31) are fixed under the axis of the rotating pallet (33). A fixed portion of the rotating support extends four fulcrums. The fulcrums are fixed on the linear slider (30). The linear slider is fixed on the linear slide rail 29 to ascend and descend synchronously along with the lift cylinder to increase stability. The stepper motor (31) is connected to the PLC control unit. The gas cylinder is movable in upper and lower directions and rotated along with the bottle bracket (28), the lifting cylinder (32), and the rotary disc, thereby facilitating transportation and weighing of the gas cylinder.

Figure 3:
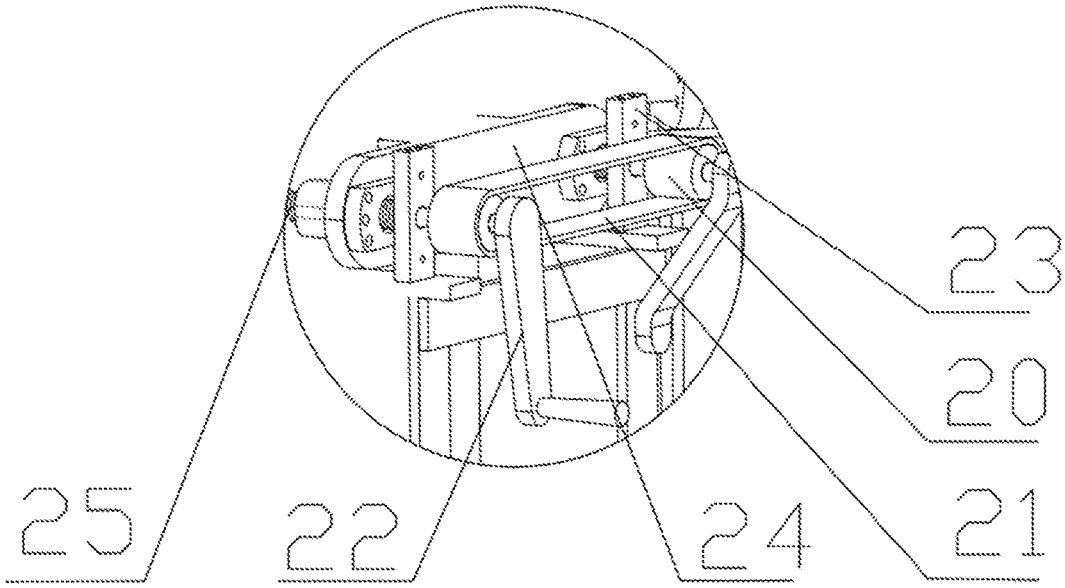
FIG. 3 is a schematic partial enlarged structural view showing a gas cylinder fixing mechanism at region C in FIG. 1.

Further, as shown in FIG. 1 and FIG. 3, an upper end of the gas cylinder fixing mechanism is fixedly provided with four fixture fixing brackets (23). The gas cylinder fixing mechanism further includes two gas cylinder fixing fixtures (24) and two bidirectional ball screws (25). Each of the bidirectional ball screws (25) passes through the two fixture fixing brackets (23) and the two gas cylinder fixing fixtures (24). One end of each of the bidirectional ball screws (25) is connected with a synchronizing belt pulley (20). One of the synchronizing belt pulleys (20) is provided with a manual crank (22), and the two synchronizing belt pulleys (20) are wound with a clamping synchronizing belt (21).

Further, as shown in FIG. 1 and FIG. 4, the gas cylinder filling fixture 14 includes two clamp bottle valve cylinders (13). The clamp bottle valve cylinder (13) is a double piston rod cylinder. The piston rods of the two clamp bottle valve cylinders (13) are connected with a set of gas filling hose fixture (39). The whole structure of the gas cylinder filling fixture is built on the stepper sliding table (3), and the stepper sliding table is slightly adjusted and moved to the right or left along with the linear slider (15) to be adapted to the deviation of the gas cylinder valve (38) and the gas cylinder filling fixture (14) detected by the center detecting sensor (16). The stepper sliding table and the clamp bottle valve cylinder (13) are connected to the PLC control unit through an electromagnetic valve.

Figure 5:
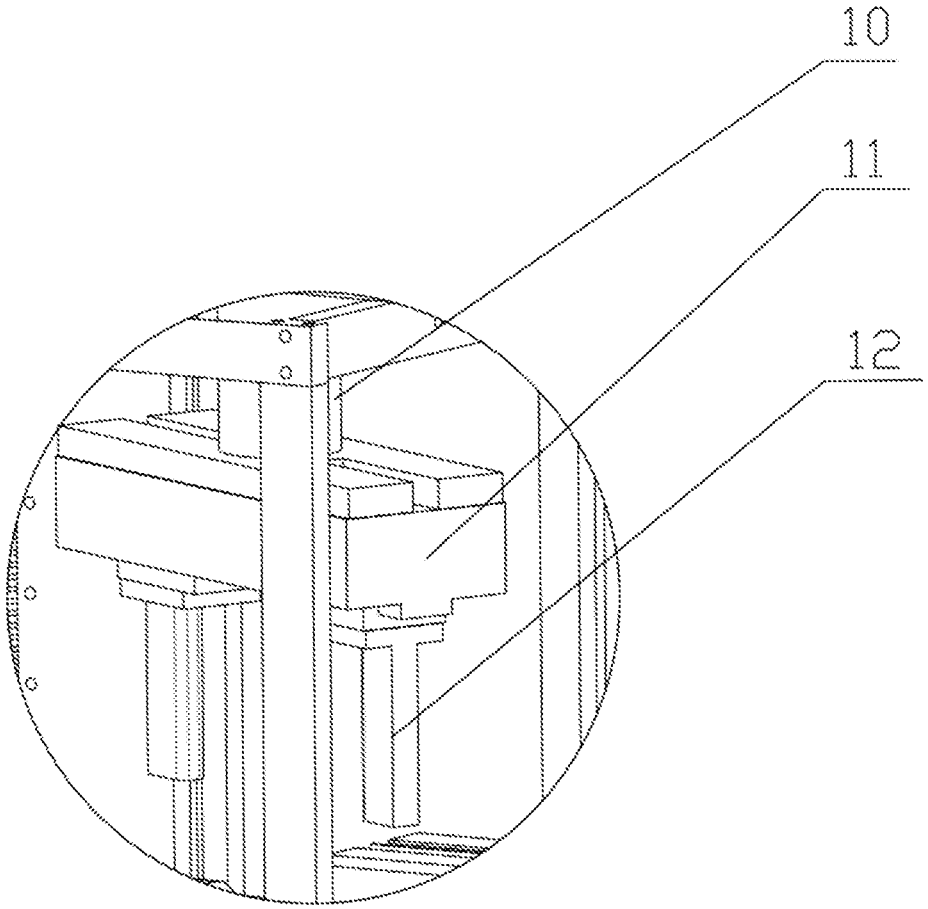
FIG. 5 is a schematic partial enlarged structural view of a bottle valve hand wheel switch mechanism at region B in FIG. 1.

Further, as shown in FIG. 1 and FIG. 5, the bottle valve hand wheel switch mechanism is installed at the upper end of the lifting frame (36). The bottle valve hand wheel switch mechanism includes a switch bottle valve motor (8). The rotating shaft of the switch bottle valve motor (8) is provided with a dynamic torque sensor (9) and a pneumatic rotary joint (10). The hand wheel clamping mechanism is mounted on the pneumatic rotary joint (10), and the switch bottle valve motor (8) is electrically connected to the PLC control unit. The hand wheel clamping mechanism includes a slide cylinder (11), and the sliding table of the slide cylinder (11) is provided with claws (12) at both ends thereof. The claws (12) are arranged vertically corresponding to the sliding table, and the slide cylinder (11) is connected to the PLC control unit.

Figure 6:
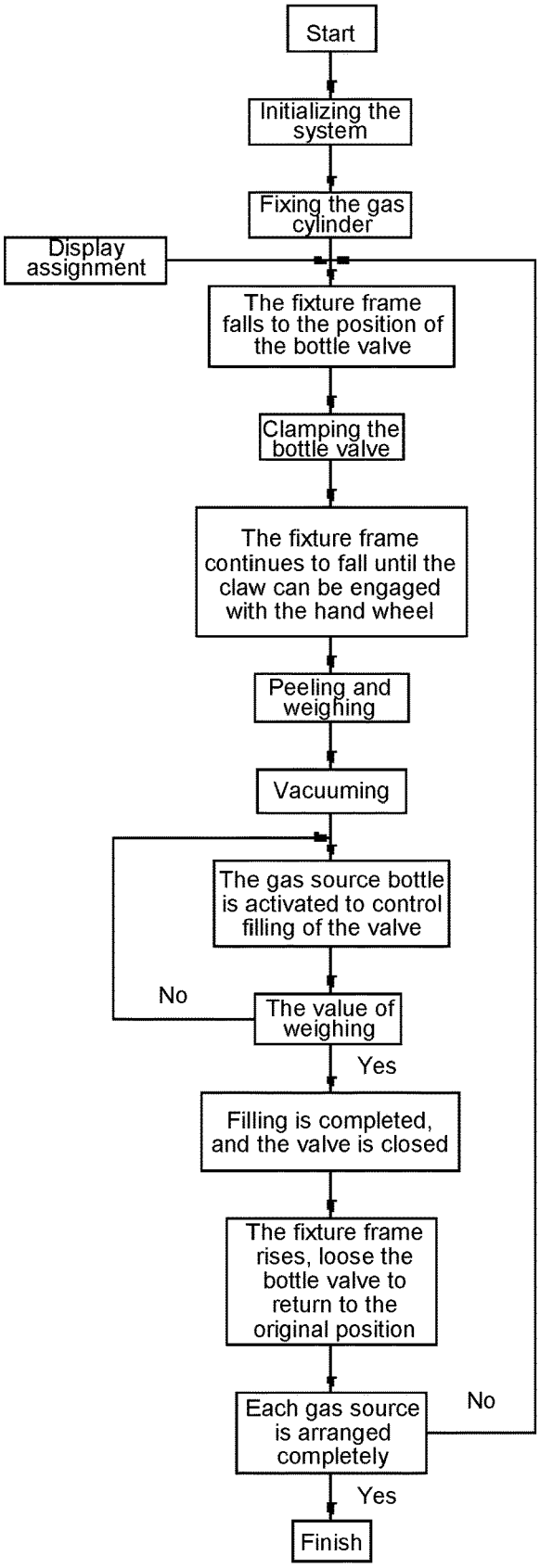
FIG. 6 is a flow chart showing operating steps of the automatic gas cylinder filling device.

The operation process of the automatic gas cylinder filling device according to the present disclosure is shown in FIG. 6. The method of operating the automatic gas cylinder filling device includes the following steps.

Step 1: A plurality of gas cylinders (19) are loaded into a cylinder fixing mechanism in sequence, and the gas cylinders are fixed by using the cylinder fixing mechanism.

Step 2: The gas cylinders are lifted and rotated in a curved manner together with the turntable in the 8-bottle gas cylinder rotating and weighing mechanism. A bottle valve of each gas cylinder is pre-aligned so that a direction of a gas inlet of the bottle valve is identical. After rotating to reach the concentric position of the lifting frame (36), the direction of the gas inlet of the bottle valve and the gas cylinder filling fixture correspond to each other.

Step 3: The lifting mechanism drives the lifting frame (36) to descend. The center detecting sensor 16 detects the opposite signal, and a center of the gas cylinder filling fixture is stopped when being concentric with a center of the bottle valve. The PLC control unit controls the gas cylinder filling fixture to fix the bottle valve 38.

Step 4: The lifting mechanism drives the lifting frame 36 to continue to descend. When the height detecting sensor (17) detects a highest position of the bottle valve (19), it is stopped when the claws of the hand wheel clamping mechanism is accurately engageable with the hand wheel. The PLC control unit controls the slide cylinder (11) to drive the claw to clamp the hand wheel. At this time, the gas cylinder filling fixture is in a suspended state.

Step 5: The lifting cylinder (32) of the 8-bottle gas cylinder rotating and weighing mechanism is automatically descended by control of the PLC control unit. The gas cylinder fixing mechanism stably falls on the electronic scale (35), and the PLC control unit controls weighing and peeling of the gas cylinder.

Step 6: The PLC control unit controls the bottle valve hand wheel switch mechanism to rotate the hand wheel according to the opening direction of the bottle valve, that is, the bottle valve is opened, and the PLC control unit controls the vacuum pump (1) to activate, and the pneumatic valve on the same pipeline is opened to vacuum the gas cylinder.

Step 7: When a vacuum degree reaches predetermined set value, the PLC control unit controls to turn off the vacuum pump (1). The PLC control unit sequentially controls each gas source cylinder to be filled into the gas cylinders (19) according to a built-in calculation software in the gas filling system. Each filling needs to be weighed. After reaching a predetermined weight, the PLC control unit controls the valve on the gas pipeline to be closed. When each gas is filled into the gas cylinder with a pre-calculated amount, the PLC control unit controls the bottle valve hand wheel switch mechanism to rotate the hand wheel in the closing direction of the bottle valve, that is, the bottle valve 38 is closed.

Step 8: The lifting mechanism lifts the lifting frame (36) until the gas cylinder filling fixture contacts a bottom end of the lifting frame (36). The PLC control unit controls the gas cylinder filling fixture to loose. At this time, the gas cylinder filling fixture and the gas cylinder valve (38) are completely detached from each other.

Step 9: The lifting mechanism continues to lift the lifting frame (36) until the lifting frame is lifted to an initial position, thereby completing a gas cylinder filling process, and the same process is repeated sequentially to complete the filling process of the 8-bottle gas cylinders.

Further, the weighing operation in the aforesaid step 5 and the step 7 includes following steps.

Step 1: The PLC control unit controls the lifting cylinder (32) to drive the gas cylinder fixing fixture (24) and the gas cylinder (19) to be completely lifted and separated from the electronic scale (35). Thereafter, the PLC control unit controls the electronic scale (35) to be zeroed.

Step 2: The PLC control unit controls the lifting cylinder (32) to drive the gas cylinder fixing fixture (24) to fall until the bottom plate of the gas cylinder fixing fixture (24) contacts the electronic scale (35) and the gas cylinder fixing fixture (24) is completely detached from the 8-bottle gas cylinder rotating and weighing mechanism. At this time, the gas cylinder (19) and the gas cylinder fixing fixture (24) are completely landed on the electronic scale (35), and the PLC control unit controls the electronic scale (35) to weigh the gas cylinder (19).

Further, in the aforesaid step 6 and the step 7, the operation that the PLC control unit controls the bottle valve hand wheel switch mechanism to rotate the hand wheel mechanism (FIG. 5) includes following steps.

Step 1: The PLC control unit controls the switch bottle valve motor (8) to rotate, and the switch bottle valve motor (8) drives the bottle valve hand wheel switch mechanism to rotate together with the hand wheel.

Step 2: During the process of closing or opening the bottle valve (38), the dynamic torque sensor (9) transmits a signal to the PLC control unit after sensing the preset torque value. Then, the PLC control unit controls the switch bottle valve motor 8 to stop rotating.

In the description of the present disclosure, the orientations or positional relationships indicated by the terms "inner", "outer", "longitudinal", "transverse", "upper", "lower", "top", "bottom", etc. are based on the orientation or positional relationship shown in the drawings, and the terms are used for the convenience of description of the disclosure and are not intended to limit that the disclosure be constructed and operated in a particular manner, and thus should not to be construed as limitation to the disclosure.

What is claimed is:

1. An automatic gas cylinder filling device, comprising:

a stand, extending in an up-down direction;

an electronic scale, mounted to a side of the stand;

a PLC control unit; and a vacuum pump mounted on an inner bottom plate of the stand, wherein the PLC control unit controls the vacuum pump to activate, wherein the side of the stand is provided with an 8-bottle gas cylinder rotating and weighing mechanism, a gas cylinder fixing mechanism connected to the 8-bottle gas cylinder rotating and weighing mechanism, a gas cylinder filling fixture, a lifting frame, and a bottle valve hand wheel switch mechanism sequentially arranged in the up-down direction away from the inner bottom plate of the stand, the electronic scale is disposed below the 8-bottle gas cylinder rotating and weighing mechanism, the gas cylinder filling fixture is disposed in the lifting frame, and the bottle valve hand wheel switch mechanism is mounted on an upper end of the lifting frame, the electronic scale, the gas cylinder filling fixture, the bottle valve hand wheel switch mechanism, and the lifting frame are respectively connected to the PLC control unit, a plurality of gas cylinders are disposed in the 8-bottle gas cylinder rotating and weighing mechanism and fixed in the gas cylinder fixing mechanism, and the vacuum pump is adapted to perform vacuuming on the gas cylinders by the PLC control unit.

2. The automatic gas cylinder filling device according to claim 1, wherein the 8-bottle gas cylinder rotating and weighing mechanism comprises a plurality of bottle brackets, a rotary disc, and a lifting cylinder;

the gas cylinders are respectively disposed in the bottle brackets, four positioning shafts and four positioning sleeves are fixedly disposed on a bottom plate of each of the bottle brackets, the rotary disc is rotatable and positioned in sequence, a piston rod of the lifting cylinder is provided with a rotating pallet;

a rotating support and a stepper motor are fixed below an axis of the rotating pallet, and the stepper motor is connected to the PLC control unit.

3. The automatic gas cylinder filling device according to claim 1, wherein an upper end of the gas cylinder fixing mechanism is fixedly provided with four fixture fixing brackets.

4. The automatic gas cylinder filling device according to claim 3, wherein the gas cylinder fixing mechanism further comprises two gas cylinder fixing fixtures and two bidirectional ball screws, each of the bidirectional ball screws passes through two of the fixture fixing brackets and the two gas cylinder fixing fixtures, the two bidirectional ball screws have ends connected with two synchronizing belt pulleys, respectively, one of the synchronizing belt pulleys is provided with a manual crank, and the two synchronizing belt pulleys are wound with a clamping synchronizing belt.

5. The automatic gas cylinder filling device according to claim 1, wherein the bottle valve hand wheel switch mechanism comprises a switch bottle valve motor, and a dynamic torque sensor and a hand wheel clamping mechanism are mounted on a rotating shaft of the switch bottle valve motor.

6. The automatic gas cylinder filling device according to claim 1, wherein the gas cylinder filling fixture comprises two clamp bottle valve cylinders, the clamp bottle valve cylinder is a double piston rod cylinder, piston rods of the two clamp bottle valve cylinders are connected with a set of gas filling hose fixture, and the clamp bottle valve cylinder is connected to the PLC control unit.

7. The automatic gas cylinder filling device according to claim 5, wherein the gas cylinder filling fixture comprises two clamp bottle valve cylinders, the clamp bottle valve cylinder is a double piston rod cylinder, piston rods of the two clamp bottle valve cylinders are connected with a set of gas filling hose fixture, and the clamp bottle valve cylinder is connected to the PLC control unit.

8. The automatic gas cylinder filling device according to claim 5, wherein the dynamic torque sensor and a pneumatic rotary joint are disposed on the rotating shaft of the switch bottle valve motor, and the hand wheel clamping mechanism is mounted on the pneumatic rotary joint.

9. The automatic gas cylinder filling device according to claim 5, wherein the hand wheel clamping mechanism comprises a slide cylinder, the slide cylinder is provided with claws at both ends of a sliding table, the claws are arranged vertically corresponding to the sliding table, and the slide cylinder is connected to the PLC control unit.

10. The automatic gas cylinder filling device according to claim 8, wherein the hand wheel clamping mechanism comprises a slide cylinder, and the slide cylinder is provided with claws at both ends of a sliding table, the claws are arranged vertically corresponding to the sliding table, and the slide cylinder is connected with the PLC control unit.

11. The automatic gas cylinder filling device according to claim 1, wherein a lateral surface of the stand is further provided with a lifting mechanism, and the lifting mechanism comprises a lifting stepper motor, a pair of ball screws and a pair of synchronizing belt pulleys, an output shaft of the lifting stepper motor is connected to one of the ball screws, and the other end of the ball screw is connected to one of the synchronizing belt pulleys, another one of the ball screws is connected to another one of the synchronizing belt pulleys, and the two synchronizing belt pulleys are wound with a synchronizing belt, the lifting stepper motor simultaneously drives the two ball screws to operate synchronously through the pair of synchronizing belt pulleys and the synchronizing belt wound thereon, each of the ball screws is provided with a nut, and the nut is fixedly disposed at an upper end of the lifting frame.

12. The automatic gas cylinder filling device according to claim 1, wherein the lifting frame is further provided with a center detecting sensor and a height detecting sensor for detecting a falling position of the lifting frame.

13. A method of operating an automatic gas cylinder filling device, the method comprises following steps:

step 1: sequentially loading a plurality of gas cylinders into a gas cylinder fixing mechanism, and fixing the gas cylinders by using the gas cylinder fixing mechanism;

step 2: lifting the gas cylinder together with a turntable in an 8-bottle gas cylinder rotating and weighing mechanism, and rotating the gas cylinder with the turntable in a curved manner, pre-aligning a gas cylinder valve so that directions of gas inlets of the gas cylinder valve are the same, after rotating to reach a concentric position of a lifting frame, corresponding the direction of gas inlet of the gas cylinder valve with a gas cylinder filling fixture;

step 3: driving a lifting frame to descend by a lifting stepper motor, detecting an opposite signal by a center detecting sensor, simultaneously stopping a center of the gas cylinder filling fixture and a center of the gas cylinder valve, controlling the gas cylinder filling fixture to fix the gas cylinder valve by a PLC control unit;

step 4: driving the lifting frame to continue to descend by the lifting stepper motor, when a height detecting sensor detects a highest position of the bottle valve, accurately engaging claws of a hand wheel clamping mechanism with a hand wheel, controlling a slide cylinder to drive the claws to clamp the hand wheel by the PLC control unit, and at this time, the gas cylinder filling fixture is in a suspended state;

step 5: automatically descending a lifting cylinder of the 8-bottle gas cylinder rotating and weighing mechanism by control of the PLC control unit, stably falling the gas cylinder fixing mechanism on an electronic scale, and taring the gas cylinder by control of the PLC control unit before weighing;

step 6: controlling a bottle valve hand wheel switch mechanism to rotate the hand wheel according to an opening direction of the bottle valve by the PLC control unit, that is, opening the bottle valve, and controlling a vacuum pump to start vacuuming the gas cylinder by the PLC control unit;

step 7: turning off the vacuum pump by the PLC control unit when a vacuum degree reaches a set value, sequentially and respectively controlling a plurality of gas source cylinders to be filled into the gas cylinders according to a built-in calculation software in a gas filling system, wherein each filling needs to be weighed, after reaching a predetermined weight, controlling a valve on a gas pipeline to be closed by the PLC control unit, when each gas is filled into the gas cylinder with a pre-calculated amount, controlling the bottle valve hand wheel switch mechanism to rotate the hand wheel in a closing direction of the bottle valve, that is, closing the bottle valve;

step 8: lifting the lifting frame by the lifting stepper motor until the gas cylinder filling fixture contacts a bottom end of the lifting frame, controlling the PLC control unit to loose the gas cylinder filling fixture, wherein at this time, the gas cylinder filling fixture and the gas cylinder valve are completely detached from each other; and step 9: continuously lifting lift the lifting frame by the lifting stepper motor until the lifting frame is lifted to an initial position, and completing a gas cylinder filling process, and sequentially repeating same process to complete the filling process.

14. The method of operating the automatic gas cylinder filling device according to claim 13, wherein the step 5 and the step 7 comprise following steps:

step 1: controlling the lifting cylinder to drive a gas cylinder fixing fixture and the gas cylinder to be completely lifted and separated from the electronic scale by the PLC control unit, thereafter, controlling the electronic scale to be zeroed by the PLC control unit; and step 2: controlling the lifting cylinder to drive the gas cylinder fixing fixture to fall until a bottom plate of the gas cylinder fixing fixture contacts the electronic scale and the gas cylinder fixing fixture is completely detached from the 8-bottle gas cylinder rotating and weighing mechanism by the PLC control unit, wherein at this time, the gas cylinder and the gas cylinder fixing fixture are completely landed on the electronic scale, and the PLC control unit controls the electronic scale to weigh the gas cylinder.

15. The method of operating the automatic gas cylinder filling device according to claim 13, wherein in the step 6 and the step 7, controlling the bottle valve hand wheel switch mechanism to rotate the hand wheel mechanism by the PLC control unit comprises following steps:

step 1: controlling a switch bottle valve motor to rotate by the PLC control unit, and driving the bottle valve hand wheel switch mechanism to rotate together with the hand wheel by the switch bottle valve motor; and step 2: during closing or opening of the bottle valve, transmitting a signal to the PLC control unit after a dynamic torque sensor sensing a preset torque value, then controlling the switch bottle valve motor to stop rotating by the PLC control unit.

* * * * *